US007164358B2

(12) United States Patent
Lian et al.

(10) Patent No.: US 7,164,358 B2
(45) Date of Patent: Jan. 16, 2007

(54) FREQUENCY DIVIDER WITH VARIABLE CAPACITANCE

(75) Inventors: Ming-Ren Lian, Boca Raton, FL (US); Ravi Todi, Orlando, FL (US); Kevin Coffey, Oviedo, FL (US); Kalpathy Sundaram, Oviedo, FL (US); Parag Gadkari, Orlando, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 257 days.

(21) Appl. No.: 10/917,112

(22) Filed: Aug. 12, 2004

(65) Prior Publication Data

US 2005/0179551 A1 Aug. 18, 2005

Related U.S. Application Data

(63) Continuation-in-part of application No. 10/780,437, filed on Feb. 17, 2004.

(51) Int. Cl.
*G08B 13/14* (2006.01)

(52) U.S. Cl. ..... 340/572.1; 340/568.1

(58) Field of Classification Search .. 340/572.1–572.9, 340/568.1–568.8, 570, 571
See application file for complete search history.

(56) References Cited

U.S. PATENT DOCUMENTS

| | | | | |
|---|---|---|---|---|
| 4,274,089 | A * | 6/1981 | Giles | 340/572.2 |
| 4,670,740 | A | 6/1987 | Herman et al. | |
| 5,065,137 | A * | 11/1991 | Herman | 340/572.2 |
| 5,065,138 | A | 11/1991 | Lian et al. | |
| 5,099,227 | A * | 3/1992 | Geiszler et al. | 340/572.5 |
| 5,510,769 | A * | 4/1996 | Kajfez et al. | 340/572.5 |
| 5,559,507 | A * | 9/1996 | Beigel | 340/10.34 |
| 5,604,485 | A * | 2/1997 | Lauro et al. | 340/572.5 |
| 6,172,608 | B1 * | 1/2001 | Cole | 340/572.1 |
| 6,243,012 | B1 * | 6/2001 | Shober et al. | 340/572.7 |
| 6,674,365 | B1 * | 1/2004 | Grabner | 340/572.5 |
| 6,894,614 | B1 * | 5/2005 | Eckstein et al. | 340/572.1 |
| 6,950,767 | B1 * | 9/2005 | Yamashita et al. | 702/81 |
| 2002/0067268 | A1 * | 6/2002 | Lee et al. | 340/572.7 |

* cited by examiner

*Primary Examiner*—Daniel Wu
*Assistant Examiner*—Jennifer Mehmood
(74) *Attorney, Agent, or Firm*—Kacvinsky LLC

(57) ABSTRACT

Method and apparatus for a frequency divider using variable capacitance are described.

24 Claims, 11 Drawing Sheets

300

FREQUENCY DIVIDER WITH VARIABLE CAPACITANCE

RELATED APPLICATIONS

This application is a Continuation-In-Part of U.S. patent application Ser. No. 10/780,437 titled "A Frequency-Division Marker For An Electronic Article Surveillance System" filed on Feb. 17, 2004, the entirety of which is hereby incorporated by reference.

BACKGROUND

An Electronic Article Surveillance (EAS) system is designed to prevent unauthorized removal of an item from a controlled area. A typical EAS system may comprise a monitoring system and one or more security tags. The monitoring system may create an interrogation zone at an access point for the controlled area. A security tag may be fastened to an item, such as an article of clothing. If the tagged item enters the interrogation zone, an alarm may be triggered indicating unauthorized removal of the tagged item from the controlled area.

Some EAS systems may use a security tag having a frequency divider to generate a signal in response to an interrogation signal. The structure of the frequency divider may, however, contribute to a loss of energy that reduces the conversion efficiency of the frequency divider. Consequently, by increasing the efficiency of the frequency divider, performance of the EAS system may be improved and the cost of the EAS system may be reduced. Accordingly, there may be need for improved frequency dividers in EAS systems.

BRIEF DESCRIPTION OF THE DRAWINGS

The subject matter regarded as the embodiments is particularly pointed out and distinctly claimed in the concluding portion of the specification. The embodiments, however, both as to organization and method of operation, together with objects, features, and advantages thereof, may best be understood by reference to the following detailed description when read with the accompanying drawings in which:

DETAILED DESCRIPTION

Figure 1:
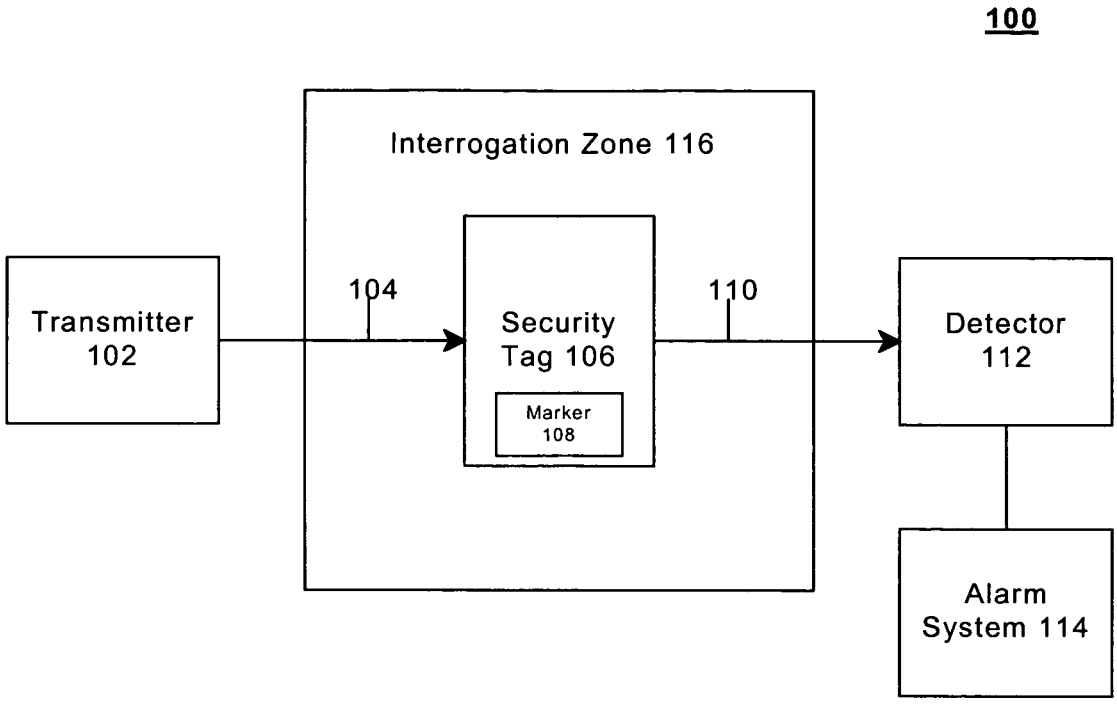
FIG. 1 illustrates an EAS system suitable for practicing one embodiment.

The embodiments may be directed to an EAS system in general. More particularly, the embodiments may be directed to a marker for an EAS security tag. The marker may comprise, for example, a frequency-division marker configured to receive input RF energy. The frequency-division marker may recondition the received RF energy, and emit an output signal with a frequency that is less than the input RF energy. In one embodiment, for example, the output signal may have half the frequency of the input RF energy. This type of frequency-division marker may be suitable for use in low bandwidth environments, such as the 13.56 Megahertz (MHz) Industrial, Scientific and Medical (ISM) band.

Conventional EAS systems are unable to effectively operate in the 13.56 MHz ISM band. Conventional EAS systems typically use a marker consisting of a single inductor-capacitor (LC) combination resonant circuit configured to resonate at a predetermined frequency. Due to the high operating frequency of the 13.56 MHz ISM band, such a marker may require an inductor with a few turns, and a capacitor ranging between 10–100 pico-farads (pF). Detecting such a single-resonance marker, however, may require a relatively complicated detection system, such as "swept RF" or "pulse" detection systems. A swept RF detection system may be capable of generating signal and receiving reflected signal at a relatively wide frequency range. A pulse detection system may create a burst of energy at a specific frequency to energize the marker, and then detects the marker's ring-down waveform. In either case, the detection system requires generating energy at a relatively wide spectrum which is not suitable for use with a 13.56 MHz system.

An EAS system using a frequency-division marker configured to operate in the 13.56 MHz ISM band may offer several advantages compared to conventional EAS systems. For example, the 13.56 MHz ISM band permits relatively high amounts of transmitting power, which may increase the detection range for an EAS system. In another example, an improved detector may be configured to perform continuous detection, and may use sophisticated signal processing techniques to improve detection range. In yet another example, the relatively high operating frequency may allow the marker to have a relatively flat geometry as well as reduce degradation under restriction, thereby making it easier to apply the marker to a monitored item.

Some embodiments may perform frequency-division using a variable capacitor. More particularly, some embodiments may use a voltage dependent variable capacitor. The variable capacitor may be implemented using a metal-oxide semiconductor (MOS) device. The MOS device may provide several advantages over conventional frequency dividers. For example, the MOS device may reduce or eliminate forward current flow through such capacitance because the insulating layer may prevent the formation of a p-n rectifying junction. In another example, the rate of change of capacitance is higher than conventional variable capacitors, thereby increasing the efficiency of the frequency divider and the marker.

Numerous specific details may be set forth herein to provide a thorough understanding of the embodiments. It will be understood by those skilled in the art, however, that the embodiments may be practiced without these specific details. In other instances, well-known methods, procedures, components and circuits have not been described in detail so as not to obscure the embodiments. It can be appreciated that the specific structural and functional details disclosed herein may be representative and do not necessarily limit the scope of the embodiments.

It is worthy to note that any reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Referring now in detail to the drawings wherein like parts are designated by like reference numerals throughout, there is illustrated in FIG. 1 an EAS system suitable for practicing one embodiment. FIG. 1 is a block diagram of an EAS system 100. In one embodiment, for example, EAS system 100 may comprise an EAS system configured to operate using the 13.56 MHz ISM band. EAS system 100, however, may also be configured to operate using other portions of the RF spectrum as desired for a given implementation. The embodiments are not limited in this context.

As shown in FIG. 1, EAS system 100 may comprise a plurality of nodes. The term "node" as used herein may refer to a system, element, module, component, board or device that may process a signal representing information. The signal may be, for example, an electrical signal, optical signal, acoustical signal, chemical signal, and so forth. The embodiments are not limited in this context.

As shown in FIG. 1, EAS system 100 may comprise a transmitter 102, a security tag 106, a detector 112 and an alarm system 114. Security tag 106 may further comprise a marker 108. Although FIG. 1 shows a limited number of nodes, it can be appreciated that any number of nodes may be used in EAS system 100. The embodiments are not limited in this context.

In one embodiment, EAS system 100 may comprise a transmitter 102. Transmitter 102 may be configured to transmit one or more interrogation signals 104 into an interrogation zone 116. Interrogation zone 116 may comprise an area between a set of antenna pedestals set at the entrance/exit point for a controlled area, for example. Interrogation signals 104 may comprise electromagnetic radiation signals having a first predetermined frequency. In one embodiment, for example, the predetermined frequency may comprise 13.56 MHz. Interrogation signals 110 may trigger a response from a security tag, such as security tag 106.

In one embodiment, EAS system 100 may comprise a security tag 106. Security tag 106 may be designed to attach to an item to be monitored. Examples of tagged items may include an article of clothing, a Digital Video Disc (DVD) or Compact Disc (CD) jewel case, a movie rental container, packaging material, and so forth. Security tag 106 may comprise marker 108 encased within a security tag housing. The security tag housing may be hard or soft, depending on the item to which security tag 106 is to be attached. Housing selection may also vary depending upon whether security tag 106 is designed to be a disposable or reusable tag. For example, a reusable security tag typically has a hard security tag housing to endure the rigors of repeated attaching and detaching operations. A disposable security tag may have a hard or soft housing, depending on such as factors as cost, size, type of tagged item, visual aesthetics, tagging location (e.g., source tagging and retail tagging), and so forth. The embodiments are not limited in this context.

In one embodiment, security tag 106 may comprise a marker 108. Marker 108 may comprise a frequency-division device having an RF antenna to receive interrogation signals, such as interrogation signals 104 from transmitter 102, for example. Marker 108 may also comprise a RF sensor to emit one or more marker signals 110 in response to interrogation signals 104. Marker signals 110 may comprise electromagnetic radiation signals having a second predetermined frequency that is different from the first predetermined frequency of interrogation signals 104. In one embodiment, for example, the first predetermined frequency may comprise 13.56 MHz and the second predetermined frequency may comprise half of 13.56 MHz, or 6.78 MHz. Marker 108 may be discussed in more detail with reference to FIGS. 2–9.

In one embodiment, EAS system 100 may comprise detector 112. Detector 112 may operate to detect the presence of security tag 106 within interrogation zone 116. For example, detector 112 may detect one or more marker signals 110 from marker 108 of security tag 106. The presence of marker signals 110 indicate that an active security tag 106 is present in interrogation zone 116. In one embodiment, detector 112 may be configured to detect electromagnetic radiation having the second predetermined frequency of 6.78 MHz, which is half the first predetermined frequency of 13.56 MHz generated by transmitter 102. Detector 112 may generate a detection signal in accordance with the detection of security tag 106.

It is worthy to note that since the marker signal is in a different frequency from the interrogation signal, a single frequency system can be employed to detect the marker signal. Detector 112 may detect the marker signal as long as its front-end circuitry is not saturated by the incoming fundamental signal of 13.56 MHz. The use of a single frequency system may increase digital signal processor (DSP) processing time to achieve better detection performance.

In one embodiment, EAS system 100 may comprise an alarm system 114. Alarm system 114 may comprise any type of alarm system to provide an alarm in response to a detection signal. The detection signal may be received from detector 112, for example. Alarm system 114 may comprise a user interface to program conditions or rules for triggering an alarm. Examples of the alarm may comprise an audible alarm such as a siren or bell, a visual alarm such as flashing lights, or a silent alarm. A silent alarm may comprise, for example, an inaudible alarm such as a message to a monitoring system for a security company. The message may be sent via a computer network, a telephone network, a paging network, and so forth. The embodiments are not limited in this context.

In general operation, EAS system 100 may perform anti-theft operations for a controlled area. For example, transmitter 102 may send interrogation signals 104 into interrogation zone 116. When security tag 106 is within the interrogation zone, marker 108 may receive interrogation signals 104. Marker 108 may generate marker signals 110 in response to interrogation signals 104. Marker signals 110 may have approximately half the frequency of interrogation signals 104. Detector 112 may detect marker signals 110, and generate a detection signal. Alarm system 114 may receive the detection signal, and generate an alarm signal to trigger an alarm in response to the detection signal.

Figure 2:
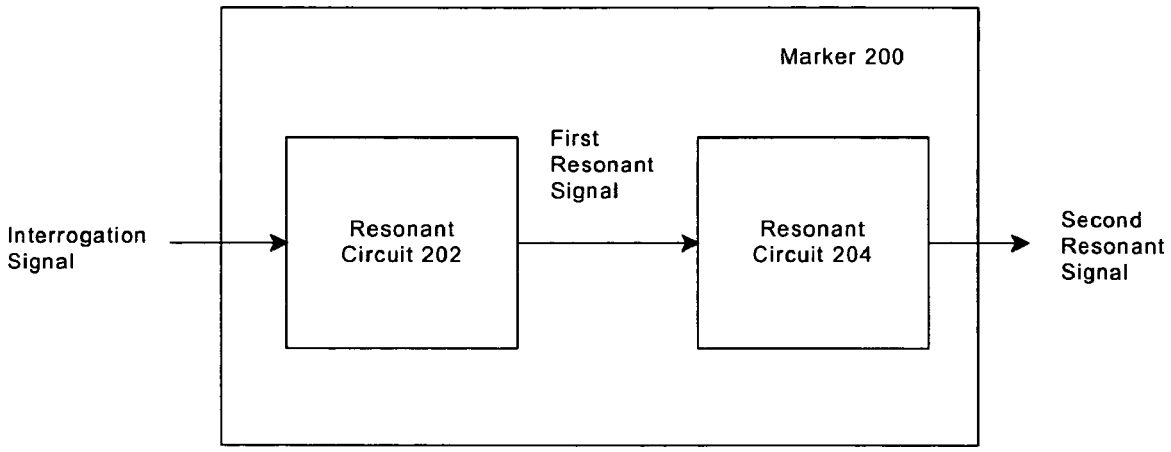
FIG. 2 illustrates a block diagram of a marker in accordance with one embodiment.

FIG. 2 may illustrate a marker in accordance with one embodiment. FIG. 2 may illustrate a marker 200. Marker 200 may be representative of, for example, marker 108. Marker 200 may comprise one or more modules. Although the embodiment has been described in terms of "modules" to facilitate description, one or more circuits, components, registers, processors, software subroutines, or any combination thereof could be substituted for one, several, or all of the modules. The embodiments are not limited in this context.

As shown in FIG. 2, marker 200 may comprise a dual resonance device. More particularly, marker 200 may comprise a first resonant circuit 202 connected to a second resonant circuit 204. Although FIG. 2 shows a limited number of modules, it can be appreciated that any number of modules may be used in marker 200.

In one embodiment, marker 200 may comprise first resonant circuit 202. First resonant circuit 202 may be a resonance LC circuit configured to receive interrogation signals 104. First resonant circuit 202 may be resonant at a first frequency F for receiving electromagnetic radiation at the first frequency F. For example, first resonant circuit 202 may generate a first resonant signal having a first resonant frequency in response to interrogation signals 110. The first resonant frequency may comprise, for example, approximately 13.56 MHz.

In one embodiment, marker 200 may comprise second resonant circuit 204. Second resonant circuit 204 may also be a resonance LC circuit configured to receive the first resonant signal from resonant circuit 202. Second resonant circuit 202 may be resonant at a second frequency F/2 that is one-half the first frequency F for transmitting electromagnetic radiation at the second frequency F/2. For example, second resonant circuit 204 may generate a second resonant signal having a second resonant frequency in response to the first resonant signal. The second resonant frequency may comprise, for example, approximately 6.78 MHz.

In one embodiment, first resonant circuit 202 and second resonant circuit 204 may be positioned relative to each other such that both circuits are magnetically coupled. The magnetic coupling may allow first resonant circuit 202 to transfer energy to second resonant circuit 204 at the first frequency F in response to receipt by first resonant circuit 202 of electromagnetic radiation at the first frequency F. Second resonant circuit 204 may be configured with a voltage dependant variable capacitor in which the reactance varies with variations in energy transferred from first resonant circuit 202. This variation may cause second resonant circuit 204 to transmit electromagnetic radiation at the second frequency F/2 in response to the energy transferred from first resonant circuit 202 at the first frequency F.

Figure 3:
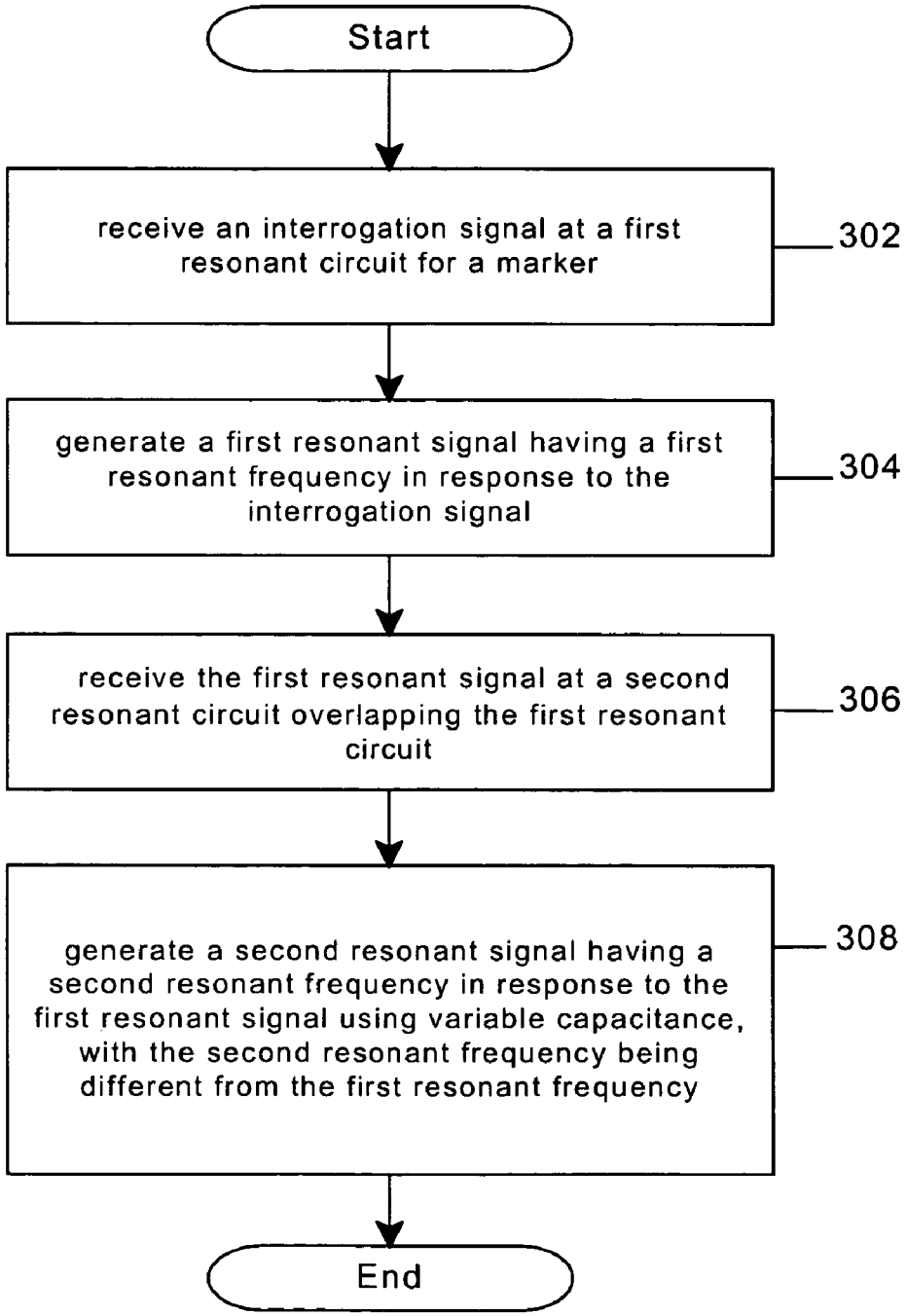
FIG. 3 is a block flow diagram of the operations performed by a marker in accordance with one embodiment.

FIG. 3 illustrates operations for a marker in accordance with one embodiment. Although FIG. 3 as presented herein may include a particular set of operations, it can be appreciated that the operations merely provide an example of how the general functionality described herein can be implemented. Further, the given operations do not necessarily have to be executed in the order presented unless otherwise indicated. The embodiments are not limited in this context.

FIG. 3 illustrates a flow of operations 300 for a marker that may be representative of the operations executed by marker 200 in accordance with one embodiment. As shown in flow 300, an interrogation signal may be received at a first resonant circuit for a marker at block 302. A first resonant signal having a first resonant frequency may be generated in response to the interrogation signal at block 304. The first resonant signal may be received at a second resonant circuit overlapping the first resonant circuit at block 306. A second resonant signal having a second resonant frequency may be generated in response to the first resonant signal using variable capacitance, with the second resonant frequency being different from the first resonant frequency, at block 308. For example, the second resonant frequency may be approximately half of the first resonant frequency.

In one embodiment, the second resonant signal may be generated using variable capacitance. The variable capacitance may be provided by, for example, a MOS device with varying amounts of capacitance corresponding to varying amounts of voltage received by the MOS device. The frequency divider in general, and the MOS device in particular, may be described in more detail with reference to FIGS. 4–9.

Figure 4:
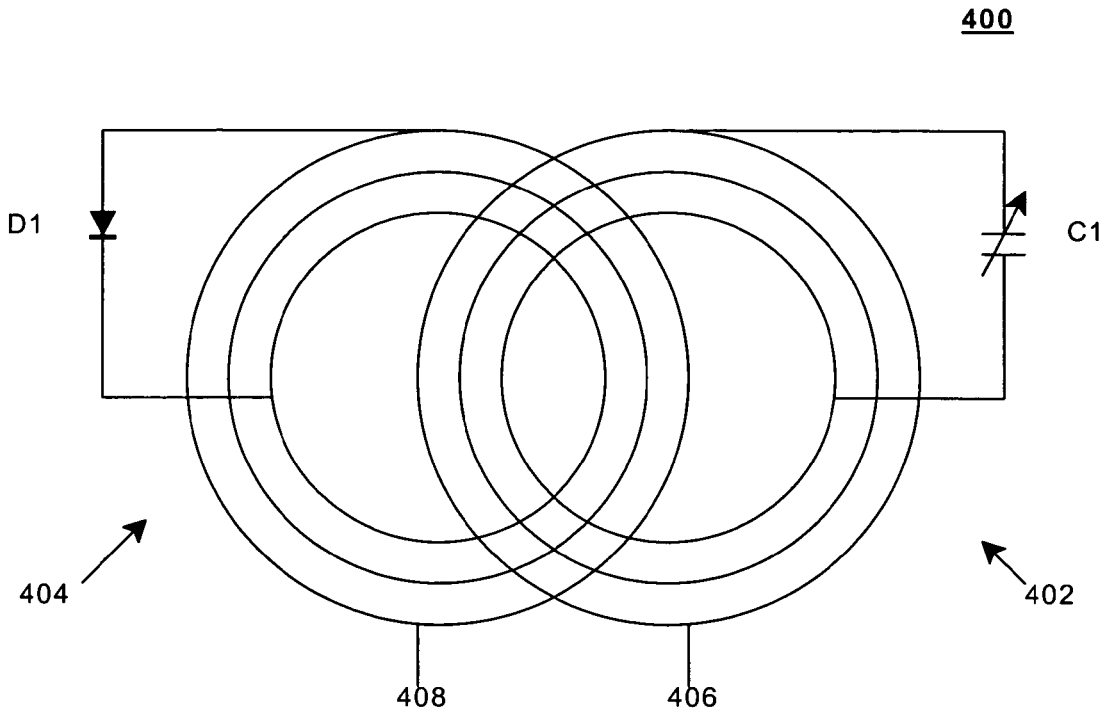
FIG. 4 is a first circuit for implementing a marker in accordance with one embodiment.

FIG. 4 is a first circuit for implementing a marker in accordance with one embodiment. FIG. 4 illustrates a circuit 400. Circuit 400 may comprise a dual resonance configuration for marker 200. In one embodiment, circuit 400 may comprise a first resonant circuit 402 and a second resonant circuit 404.

In one embodiment, circuit 400 may comprise one or more planarized coils. The term "planarized coil" as used herein may refer to a coil having a relatively flat geometry. For example, the planarized coil may be less than 1 millimeter (mm) thick. In another example, the planarized coil may be approximately 0.2 mm or 200 microns thick. The thickness of any given planarized coil may vary according to a given implementation, and the embodiments are not limited in this context.

In one embodiment, circuit 400 may comprise first resonant circuit 402. First resonant circuit 402 may comprise an LC combination. For example, first resonant circuit 402 may comprise a first planarized coil 406 having a pair of terminals and a capacitor C1 connected to the pair of terminals. Capacitor C1 may comprise a linear or non-linear capacitor depending on a given implementation. In one embodiment, for example, capacitor C1 may comprise a linear capacitor. First resonant circuit 402 may be resonant at a first predetermined frequency when receiving electromagnetic radiation at the first predetermined frequency. The number of turns for first planarized coil 406 may vary depending on the frequency of interrogation signals 104. With an operating frequency of 13.56 MHz, first planarized coil 406 may have approximately 10 turns, which may be sufficient for resonance and transmitter coupling needed to induce the appropriate operating voltage. As it receives the electromagnetic energy from transmitter 102, first resonant circuit stores and amplifies the field. The field may be passed to second resonant circuit 404 through the magnetic coupling discussed below.

In one embodiment, circuit 400 may comprise second resonant circuit 404. Second resonant circuit 404 may also comprise an LC combination. For example, second resonant circuit 404 may comprise a second planarized coil 408 having a pair of terminals and a non-linear capacitor D1 connected to the pair of terminals. Non-linear capacitor D1 may operate as a voltage dependent variable capacitor. Second resonant circuit 404 may receive the amplified field from first resonant circuit 402, and generates a second resonant signal at a second resonant frequency that is half the frequency of the interrogation signal and first resonant signal. In one embodiment, for example, second resonant circuit 404 may generate the second resonant signal at 6.78 MHz with a magnetic field threshold of approximately 10 mA/m rms.

One advantage of circuit 400 is that it may have a lower magnetic field threshold as compared to conventional frequency-division circuits. The frequency-division process has a minimum threshold below which it will not operate. Therefore, the transmitting field at the marker must exceed a minimum magnetic field threshold. The lower the threshold, the more sensitive the marker becomes. Conventional frequency-division markers using an inductor-zener diode combination may have a typical turn-on threshold of approximately 100 mA/m rms. In one embodiment, circuit 400 may output a marker signal at 6.78 MHz with a magnetic field threshold of approximately 10 mA/m rms. As a result, marker 200 using circuit 400 may result in a more sensitive marker for improved EAS functionality.

As shown in FIG. 4, first planarized coil 406 and second planarized coil 408 are positioned so that they overlap each other by a predetermined amount to form a double tuned circuit. The amount of overlap determines the degree of mutual coupling k between the magnetic fields of each resonant circuit. To perform frequency division, the coupling coefficient k between first planarized coil 406 of first resonant circuit 402 and second planarized coil 408 of second resonant circuit 404 should be within a range of 0.0 to 0.6. In one embodiment, for example, k may comprise 0.3 to perform sufficient coupling between the fields.

Second resonant circuit 404 may utilize a non-linear capacitor for D1. The particular non-linear capacitor element may be determined in accordance with a number of different factors. For example, one factor may be capacitance non-linearity (dC/dV). The turn on magnetic field threshold may depend on the dC/dV value at zero voltage bias condition. The higher the dC/dV value, the lower the threshold. In another example, one factor may be capacitive dissipation (Df). The dissipation factor determines the amount of energy a resonant LC circuit can store. The lower the Df, the more efficient the circuit may operate. Other factors such as inductor-capacitor ratio and coil loss may also influence the frequency-dividing functionality.

In one embodiment, for example, second resonant circuit 404 may use a MOS device as the non-linear capacitor. A MOS capacitor may offer superior dC/dV characteristics relative to conventional capacitors. This may improve device sensitivity significantly. In addition, proximity deactivation can be achieved through the breakdown mechanism of the MOS device. The MOS breakdown voltage can be controlled by adjusting the thickness of the oxide layers. To deactivate, a F/2 frequency may be generated and resonated in the inductor-nonlinear capacitor resonator until the MOS breakdown voltage is reached. An example of a MOS device may be described in more detail with reference to FIGS. 5–9.

Figure 5A:
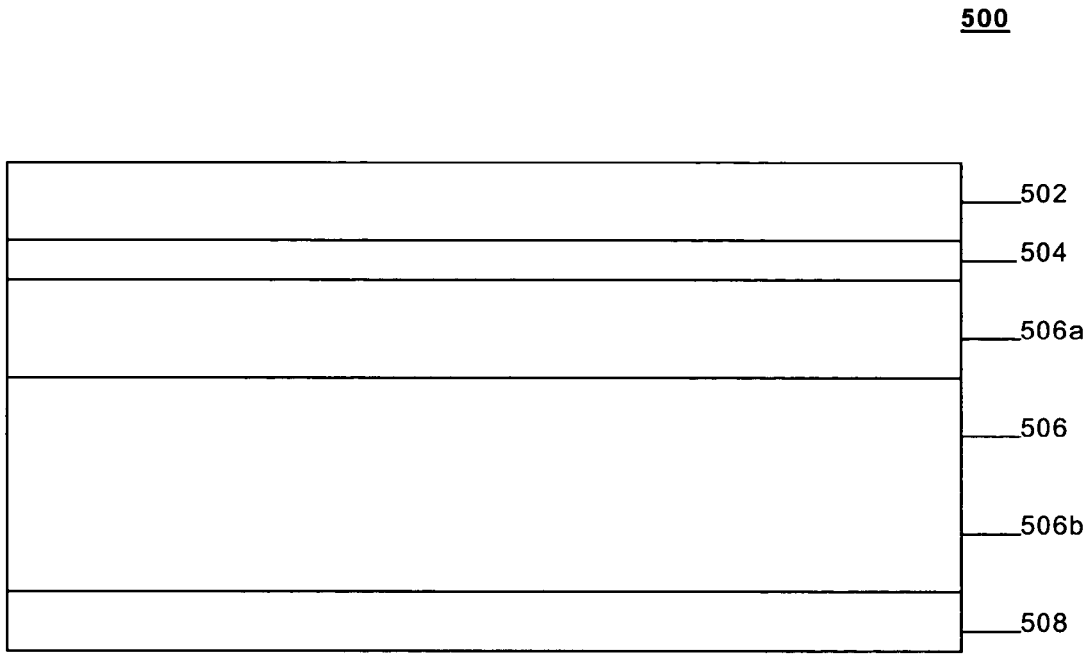
FIG. 5A is a sectional view of a capacitance element without a voltage being applied across the terminals in accordance with one embodiment.

FIG. 5A is a sectional view of a capacitance element without a voltage being applied across the terminals in accordance with one embodiment. FIG. 5A may illustrate a variable capacitor 500. Variable capacitor 500 may be implemented using, for example, a MOS device. Variable capacitor 500 may comprise a lamination of a dielectric insulation material 504 and a semiconductor material 506 disposed between a first metal terminal 502 and a second metal terminal 508. First metal terminal 502 may also be referred to as a gate. The maximum value of the capacitance C may be determined by a number of factors, such as the area of first metal terminal 502, the dielectric constant and thickness of insulation material 504, and so forth. The embodiments are not limited in this context.

In one embodiment, variable capacitor 500 may include semiconductor material 506. Semiconductor material 506 may comprise a p-type substrate or an n-type substrate, depending upon a given implementation. When semiconductor material 506 is implemented using a p-type substrate, variable capacitor 500 may comprise an N-MOS capacitor since the inversion layer contains electrons. When semiconductor material 506 is implemented using an n-type substrate, variable capacitor 500 may comprise a P-MOS capacitor.

In one embodiment, semiconductor material 506 may comprise an epitaxial layer 506*a* having a first amount of doping adjacent to insulation material 504, and a substrate 506*b* having a second amount of doping between epitaxial layer 506*a* and second metal terminal 508. In one embodiment, for example, the first amount of doping is less than the second amount of doping. Such relative doping may decrease the series resistance in semiconductor material 506, as discussed in more detail with reference to FIG. 6.

Figure 5B:
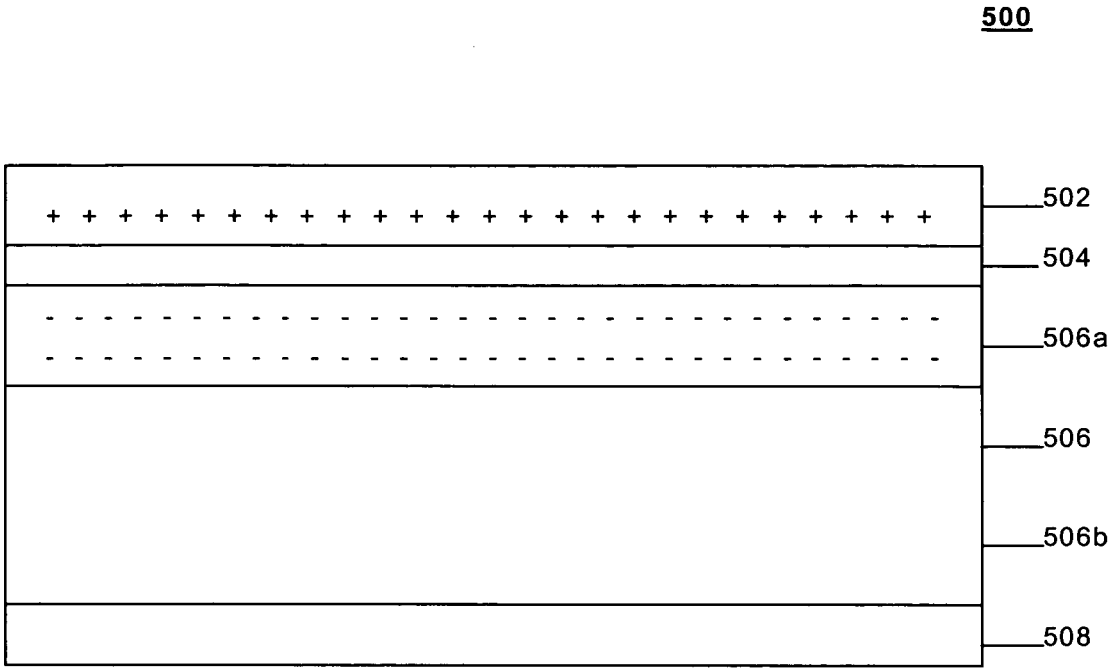
FIG. 5B is a sectional view of a capacitance element when a voltage is applied across the terminals in accordance with one embodiment.

FIG. 5B is a sectional view of a capacitance element when a voltage is applied across the terminals in accordance with one embodiment. As shown in FIG. 5B, voltage may be applied across the terminals to deplete the concentration of charge carriers in the region of the semiconductor material adjacent to the insulation material, thereby decreasing the capacitance of the capacitance element.

In one embodiment, for example, semiconductor material 506 may be implemented using an n-type silicon. When a negative voltage is applied to first metal terminal 502 relative to second metal terminal 508, charge carriers in the lightly doped epitaxial layer 506*a* are repelled from the interface of insulation material 504 and the lightly doped epitaxial layer 506*a* in a region adjacent to insulation material 504. The depletion of charge carriers may expose silicon ions in the region adjacent to insulation material 504. This may establish a second capacitance in series with a first capacitance established by insulation material 504. The second capacitance combined with the first capacitance may decrease the overall capacitance of variable capacitor 500. As the voltage becomes more negative, the overall capacitance of variable capacitor 500 is decreased.

In one embodiment, for example, semiconductor material 506 may be implemented using a p-type silicon. When a positive voltage is applied to first metal terminal 502 relative to second metal terminal 508, charge carriers in the lightly doped epitaxial layer 506*a* are repelled from the interface of insulation material 504 and the lightly doped epitaxial layer 506*a* in a region adjacent to insulation material 504. The depletion of charge carriers may expose silicon ions in the region adjacent to insulation material 504. This may establish a second capacitance in series with a first capacitance established by insulation material 504. The second capacitance combined with the first capacitance may decrease the overall capacitance of variable capacitor 500. As the voltage becomes more negative, the overall capacitance of variable capacitor 500 is decreased.

Figure 5C:
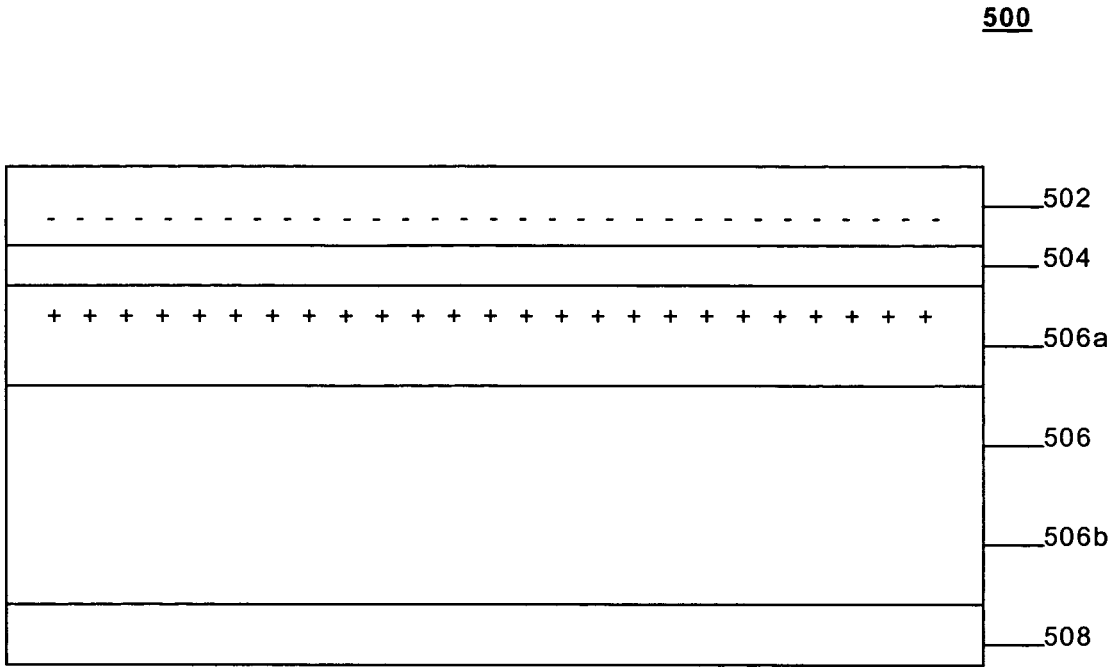
FIG. 5C is a sectional view of a capacitance element when a voltage is applied across the terminals in accordance with one embodiment.

FIG. 5C is a sectional view of a capacitance element when a voltage is applied across the terminals in accordance with one embodiment. As shown in FIG. 5C, voltage may be applied across the terminals to enhance the concentration of charge carriers in the region of the semiconductor material adjacent to insulation material 504, thereby increasing the capacitance of the capacitance element.

Referring again to the example where semiconductor material 506 is implemented using an n-type silicon, when a positive voltage is applied to first metal terminal 502 relative to second terminal 508, charge carriers in the lightly doped epitaxial layer 506*a* are attracted to the interface of insulation material 504 and the lightly doped epitaxial layer 506*a* to enhance the concentration of charge carriers in the lightly doped epitaxial layer 506*a* in the region adjacent to insulation material 504. The enhancement of charge carriers may reduce the region of exposed ions and thereby increase the overall capacitance of variable capacitor 500. As the voltage applied to first metal terminal 502 becomes more positive, the overall capacitance of variable capacitor 500 is increased.

Referring again to the example where semiconductor material 506 is implemented using a p-type silicon, when a negative voltage is applied to first metal terminal 502 relative to second terminal 508, charge carriers in the lightly doped epitaxial layer 506*a* are attracted to the interface of insulation material 504 and the lightly doped epitaxial layer 506*a* to enhance the concentration of charge carriers in the lightly doped epitaxial layer 506*a* in the region adjacent to insulation material 504. The enhancement of charge carriers may reduce the region of exposed ions and thereby increase the overall capacitance of variable capacitor 500. As the voltage applied to first metal terminal 502 becomes more positive, the overall capacitance of variable capacitor 500 is increased.

Figure 6:
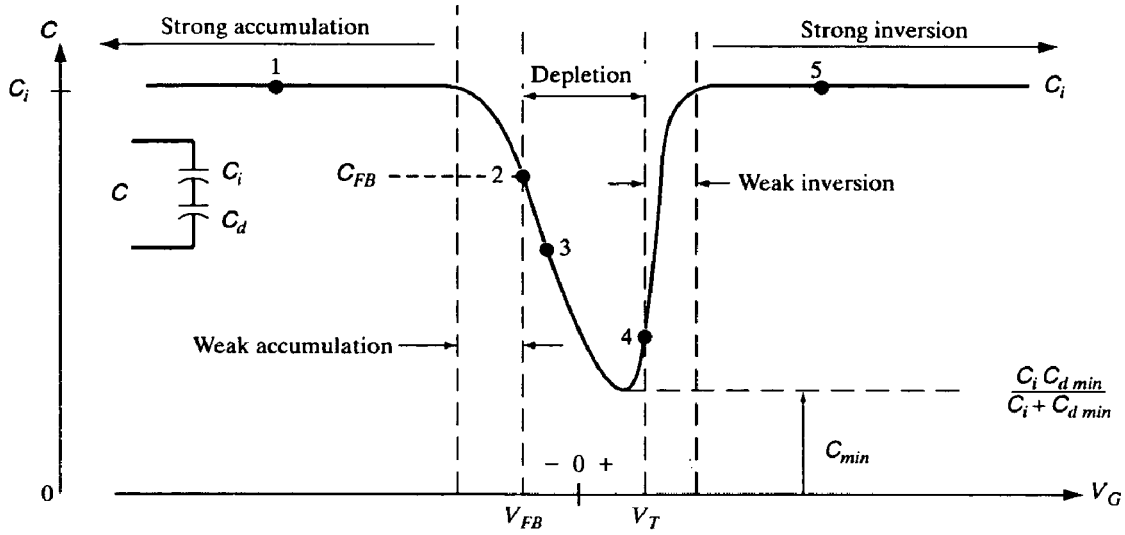
FIG. 6 illustrates a graph of capacitance versus gate voltage in accordance with one embodiment.

FIG. 6 illustrates a graph of capacitance versus gate voltage in accordance with one embodiment. FIG. 6 illustrates a typical CV curve for a p-substrate MOS capacitor. Three major operational regions are also indicated. A circuit insert shows the overall capacitance during the depletion mode.

In one embodiment, FIG. 6 illustrates the relation of capacitance and applied gate voltage of a P-substrate material. There are three main operation regions for variable capacitor 500, that is, accumulation, depletion, and inversion. With a negative gate voltage, the device is in the accumulation mode. The negative gate voltage attracts the majority carrier (in this case, hole carrier), which forms a capacitor mainly contributed by the oxide layer ($C_i$). The unit capacitance ($C_{MOS}$) may be expressed as part of equation (1) as follows:

$$C_{MOS} = C_i = \frac{\varepsilon_i}{d} \tag{1}$$

where $\epsilon_i$ and d are the permittivity and the thickness of the insulator layer.

As the gate voltage becomes more positive, the MOS device enters into the depletion mode, where the majority hole carriers are expelled away from the Si, insulator junction. This forms an addition capacitor (depletion capacitance $C_d$) in series connection with $C_i$. Therefore we have:

$$C_{MOS} = \frac{C_i \cdot C_d}{C_i + C_d} \tag{2}$$

$$C_d = \frac{\varepsilon_{Si}}{W_d} \tag{3}$$

where $\epsilon_{Si}$, and $W_d$ are the permittivity of Silicon, and width of the depletion layer respectively. The net MOS capacitance drops almost linearly with the increase of the gate voltage (in the case of p-substrate MOS device), until the voltage reaches the inversion threshold. At this moment, the silicon-insulator interface is flooded with the electron carriers, and the width of the depletion region reaches its maximum. As a result, the overall capacitance $C_{MOS}$ remains constant, as long as the signal frequency is high, and the carrier cannot respond due to limited drift speed. With a low frequency condition, the capacitance $C_{mos}$ reverts back to the value of $C_i$, as shown in FIG. 6.

Figure 7:
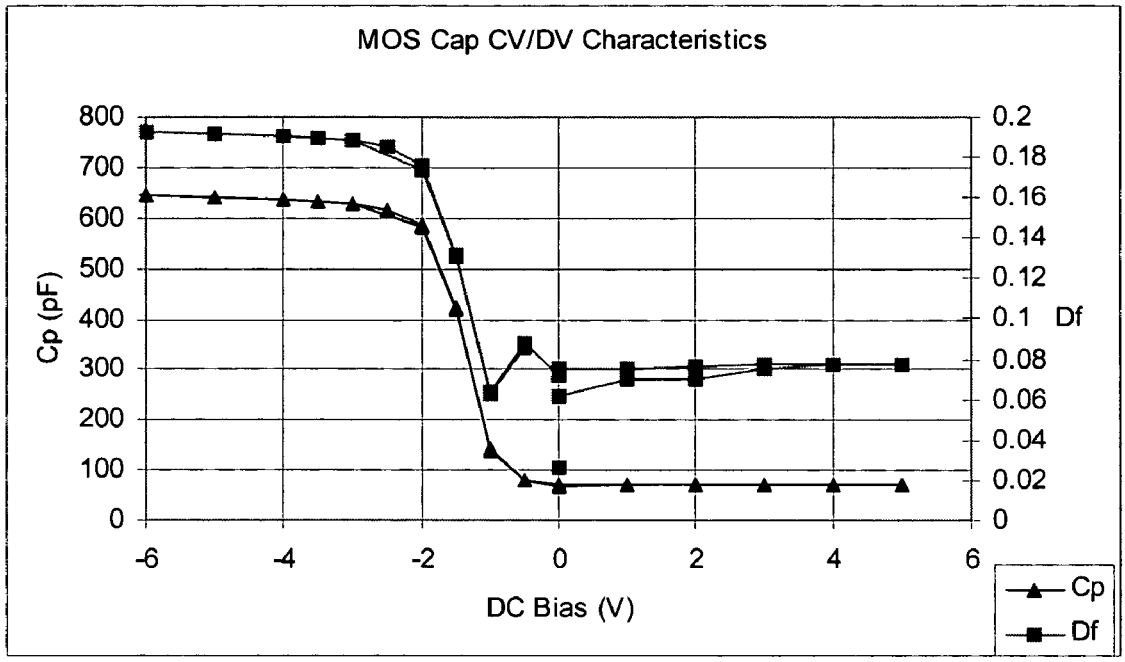
FIG. 7 illustrates a graph of the measured capacitance and dissipation data (CV/DV) characteristics of a metal-oxide semiconductor (MOS) device in accordance with one embodiment.

FIG. 7 illustrates a graph of the measured capacitance and dissipation data (CV/DV) characteristics of a MOS device in accordance with one embodiment. FIG. 7 shows the CV/DV for a p-type substrate MOS capacitor with a measuring frequency set at 1 Megahertz (MHz). The CV curve substantially conforms to the theoretic trend depicted in FIG. 7. There is approximately eight (8) times of capacitance swing as the gate voltage, such as from 80 pF to 630 pF, for example. It is also worthy to note that the maximum rate of capacitance change occurs at approximately negative 1.3 volts. In an EAS application, it may be critical to design the device material and process condition so that such a maximum rate change occurs around zero volt region. This can be achieved through careful selection of gate metal material. The work function of the metal will be effective in modifying the flat band voltage, thus shifting the CV curve along the voltage axis. Some of the suitable gate materials may include, for example, Au, Mo, Ta, and polysilicon. The embodiments are not limited in this context.

FIG. 7 may also illustrate the dissipation characteristics of variable capacitor 500. The dissipation factor (D) is defined as the ratio of energy loss vs. energy storage in the capacitor, as shown below for a series circuits model:

$$D = \omega \cdot C \cdot R \tag{4}$$

where ω is the operating angular frequency, and R is the series resistance, which may result from contact or the bulk silicon layer.

The trend of the dissipation may be similar to the CV curve. This may indicate significant series bulk resistance, resulting in substantial loss especially at a high capacitance region. To reduce such a bulk resistance, it may be desirable to use a high doping concentration for the substrate. This may also negatively impact the device performance, however, by reducing the characteristics of capacitance modulation.

Figure 8:
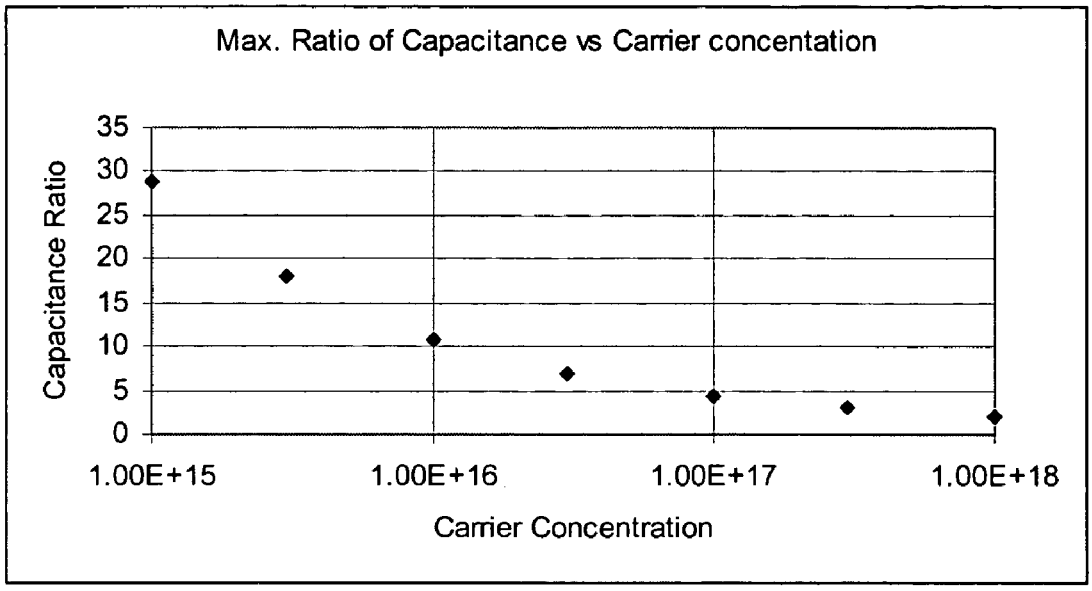
FIG. 8 illustrates a graph of carrier concentration versus capacitance ratio in accordance with one embodiment.

FIG. 8 illustrates a graph of carrier concentration versus capacitance ratio in accordance with one embodiment. FIG. 8 shows the maximum capacitance ratio as a function of carrier concentration for a MOS capacitor with 100-Angstrom gate dielectrics. The use of highly doped silicon substrate is shown to reduce the maximum capacitance ratio. It is possible to resolve this conflict by using a highly doped silicon wafer with a thin epitaxial layer with a low carrier concentration, since the maximum depletion width is normally less than one micron. An example of a thickness for an epitaxial layer may comprise 1 μm. The embodiments, however, are not limited in this context.

The MOS structure may be developed in a number of different ways. For example, the MOS structure may start with an insulated substrate. A bottom conductor layer pattern may be deposited. The bottom layer may be followed by depositing a thin silicon layer with a predetermined level of impurity concentration. A thin oxide layer may then be created by either deposition or thermal growth over the silicon layer, followed by another metallization process to form the top electrode. Finally a patterning operation may be performed to expose the bottom electrode for contact purpose.

In one embodiment, variable capacitor 500 may be developed using printed electronics techniques. Printed electronics techniques may offer the potential of lower costs, a larger printing area, flexible substrates, and so forth. In one embodiment, for example, the complexity of the above development operations can be reduced by printing each respective layer, and obviating the patterning operations.

The printing operation may start with a printable/treatable substrate. In one embodiment, the substrate may be a flexible substrate. The bottom electrode may be printed. The semiconductor layer may be printed or deposited. The thin dielectric layer may be printed or deposited. Finally, the top electrode may be printed.

Figure 9:
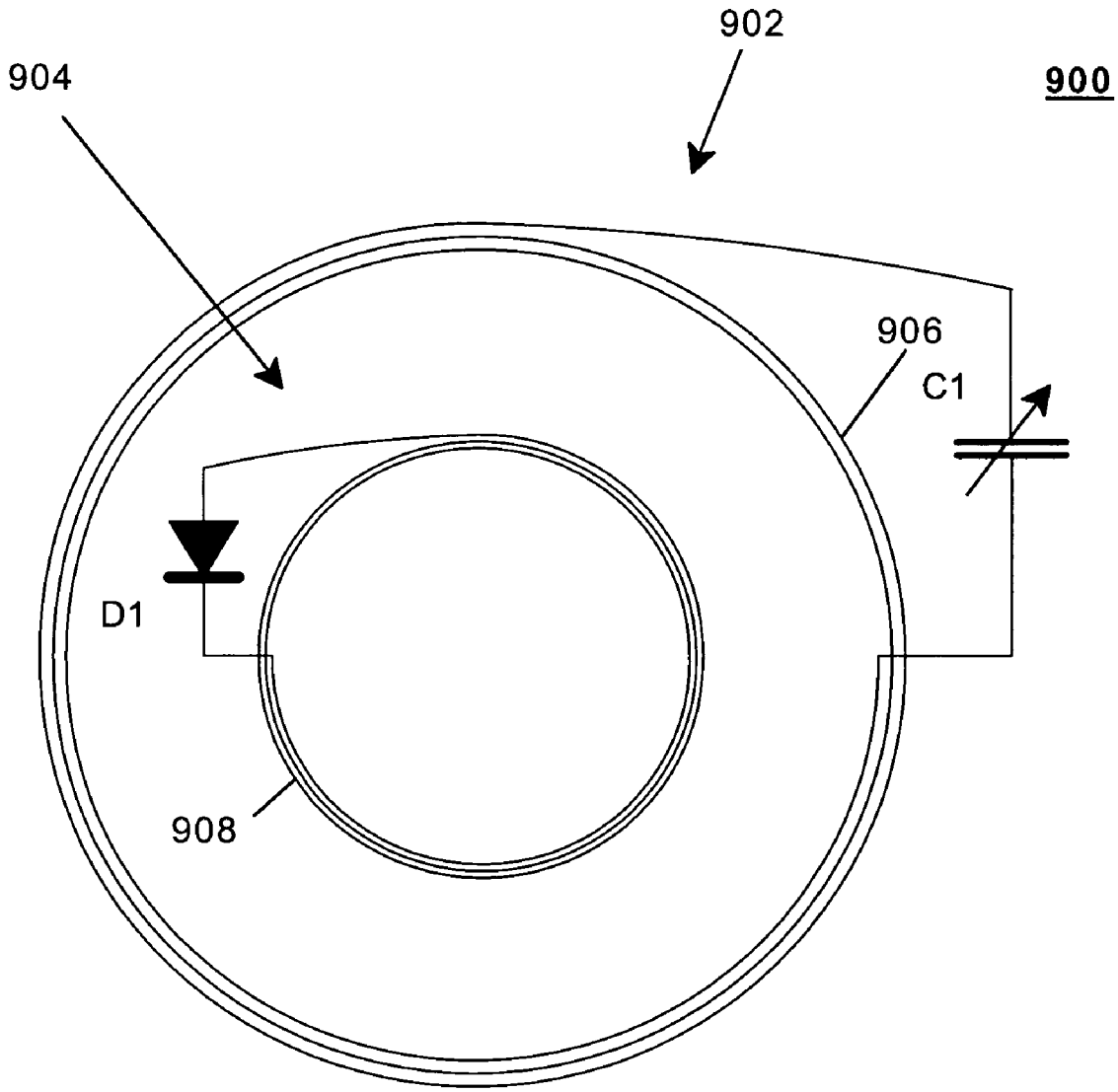
FIG. 9 is a second circuit for implementing a marker in accordance with one embodiment.

FIG. 9 is a second circuit for implementing a marker in accordance with one embodiment. FIG. 9 illustrates a circuit 900. Circuit 900 may comprise a different dual resonance configuration for marker 200. In one embodiment, circuit 900 may comprise a first resonant circuit 902 and a second resonant circuit 904. First resonant circuit 902 and second resonant circuit 904 may be similar to first resonant circuit 402 and second resonant circuit 404, respectively. First resonant circuit 902 may comprise a first planarized coil 906 and a linear capacitor C1. Second resonant circuit 904 may comprise a second planarized coil 908 and a non-linear capacitor D1.

In one embodiment, circuit 900 comprises a coil arrangement to achieve a coupling of 0.3. Circuit 900 may illustrate a dual-resonance configuration having one LC resonant circuit within another LC resonant circuit. As shown in circuit 900, second resonant circuit 904 may be nested within first planarized coil 906 of first resonant circuit 902. By placing the F resonant circuit outside the F/2 resonant circuit, this configuration may provide improved sensitivity by increasing the field capture area. Although circuit 900 shows second resonant circuit 904 being nested within first planarized coil 906, it may be appreciated that the reverse configuration may be implemented and still fall within the scope of the embodiments. The embodiments are not limited in this context.

Frequency division markers such as circuits 400 and 900 may be manufactured in a number of different ways. For example, the inductor metal pattern can be deposited, etched, stamped, or otherwise placed on a thin and flexible substrate. The non-linear capacitor may be bonded to the inductor terminals. Conventional bonding techniques may result in a marker having a slight bump due to the placement of the nonlinear capacitor element. To avoid this bump, a printed semiconductor process may be used. The printed semiconductor process can fabricate conductor patterns and the nonlinear capacitor element in a single, flexible substrate in a mass-production scale. The embodiments are not limited in this context.

Although the embodiments have been discussed in terms of dual-resonance configurations, it may be appreciated that a single LC resonant circuit may also be implemented using the principles discussed herein. For example, a single LC resonant circuit comprising a non-linear capacitor (e.g., variable capacitor 500) and planarized coil may be configured to operate in the 13.56 MHz band. The higher operating frequencies may result in reduced geometries and smaller form factors for the single LC resonant circuit, while still emitting a detectable resonant signal at the appropriate frequency. The embodiments are not limited in this context.

Some embodiments may be implemented using an architecture that may vary in accordance with any number of factors, such as desired computational rate, power levels, heat tolerances, processing cycle budget, input data rates, output data rates, memory resources, data bus speeds and other performance constraints. For example, an embodiment may be implemented using software executed by a general-purpose or special-purpose processor. In another example, an embodiment may be implemented as dedicated hardware, such as a circuit, an application specific integrated circuit (ASIC), Programmable Logic Device (PLD) or digital signal processor (DSP), and so forth. In yet another example, an embodiment may be implemented by any combination of programmed general-purpose computer components and custom hardware components. The embodiments are not limited in this context.

Some embodiments may be described using the expression "coupled" and "connected" along with their derivatives. It should be understood that these terms are not intended as synonyms for each other. For example, some embodiments may be described using the term "connected" to indicate that two or more elements are in direct physical or electrical contact with each other. In another example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

While certain features of the embodiments have been illustrated as described herein, many modifications, substitutions, changes and equivalents will now occur to those skilled in the art. It is therefore to be understood that the appended claims are intended to cover all such modifications and changes as fall within the true spirit of the embodiments.

The invention claimed is:

1. A marker, comprising:

a first resonant circuit comprising a first planarized coil having a pair of terminals and a capacitor connected to said pair of terminals, said first resonant circuit to generate a first resonant signal in response to an interrogation signal; and a second resonant circuit comprising a second planarized coil having a pair of terminals and a variable capacitor connected to said pair of terminals, with a portion of said second planarized coil to overlap a portion of said first planarized coil, said second resonant circuit to receive said first resonant signal and generate a second resonant signal having a second resonant frequency;

wherein said variable capacitor comprises a metal-oxide semiconductor device, said metal-oxide semiconductor device to operate as a non-linear capacitor having varying amounts of capacitance corresponding to varying amounts of voltage received by said metal-oxide semiconductor device; and wherein said metal-oxide semiconductor device comprises a lamination of an insulation material and a semiconductor material disposed between metal terminals, and as said voltage applied across said terminals varies, a concentration of charge carriers in a region of said semiconductor material adjacent to said insulation material also varies to thereby vary said capacitance.

2. The marker of claim 1, wherein said semiconductor material comprises an epitaxial layer having a first amount of doping adjacent to said insulation material, and a substrate having a second amount of doping between said epitaxial layer and one of said metal terminals.

3. The marker of claim 2, wherein said first amount of doping is less than said second amount of doping.

4. The marker of claim 1, wherein said second resonant frequency is less than said first resonant frequency.

5. The marker of claim 1, wherein said second resonant frequency is approximately half of said first resonant frequency.

6. The marker of claim 1, wherein said interrogation signal operates at approximately 13.56 Megahertz.

7. The marker of claim 1, wherein said first resonant frequency comprises approximately 13.56 Megahertz, and said second resonant frequency comprises approximately 6.78 Megahertz.

8. The marker of claim 1, wherein said metal terminals comprises at least one of a group of materials including Au, Mo, Ta and polysilicon.

9. The marker of claim 1, wherein said marker is developed using a printed semiconductor process.

10. A system, comprising:

a transmitter to transmit an interrogation signal operating at a first frequency;

a security tag having a marker, said marker comprising:

a first resonant circuit comprising a first planarized coil having a pair of terminals and a capacitor connected to said pair of terminals, said first resonant circuit to generate a first resonant signal in response to said interrogation signal;

a second resonant circuit comprising a second planarized coil having a pair of terminals and a variable capacitor connected to said pair of terminals, with a portion of said second planarized coil to overlap a portion of said first planarized coil, said second resonant circuit to receive said first resonant signal and generate a second resonant signal having a second resonant frequency;

wherein said variable capacitor comprises a metal-oxide semiconductor device, said metal-oxide semiconductor device to operate as a non-linear capacitor having varying amounts of capacitance corresponding to varying amounts of voltage received by said metal-oxide semiconductor device; and a detector to detect said second resonant signal from said marker and generate a detection signal in accordance with said second resonant signal;

wherein said metal-oxide semiconductor device comprises a lamination of an insulation material and a semiconductor material disposed between metal terminals, and as said voltage applied across said terminals varies, a concentration of charge carriers in a region of said semiconductor material adjacent to said insulation material also varies to thereby vary said capacitance.

11. The system of claim 10, wherein said semiconductor material comprises an epitaxial layer having a first amount of doping adjacent to said insulation material, and a substrate having a second amount of doping between said epitaxial layer and one of said metal terminals.

12. The system of claim 11, wherein said first amount of doping is less than said second amount of doping.

13. The system of claim 10, wherein said second resonant frequency is less than said first resonant frequency.

14. The system of claim 10, wherein said second resonant frequency is approximately half of said first resonant frequency.

15. The system of claim 10, wherein said interrogation signal operates at approximately 13.56 Megahertz.

16. The system of claim 10, wherein said first resonant frequency comprises approximately 13.56 Megahertz, and said second resonant frequency comprises approximately 6.78 Megahertz.

17. The system of claim 10, wherein said metal terminals comprises at least one of a group of materials including Au, Mo, Ta and polysilicon.

18. The system of claim 10, further comprising an alarm system to connect to said receiver, said alarm system to receive said detection signal and generate an alarm in response to said detection signal.

19. The system of claim 10, wherein said marker is developed using a printed semiconductor process.

20. A method, comprising:

receiving an interrogation signal at a first resonant circuit for a marker;

generating a first resonant signal having a first resonant frequency in response to the interrogation signal;

receiving said first resonant signal at a second resonant circuit overlapping said first resonant circuit; and generating a second resonant signal having a second resonant frequency in response to said first resonant signal using variable capacitance, with said second resonant frequency being different from said first resonant frequency;

wherein the variable capacitance is provided by a metal-oxide semiconductor device, the metal-oxide semiconductor device comprising a lamination of an insulation material and a semiconductor material disposed between metal terminals, and as a voltage applied across the terminals varies, a concentration of charge carriers in a region of the semiconductor material adjacent to the insulation material also varies to thereby vary the capacitance.

21. The method of claim 20, wherein said second resonant frequency is less than said first resonant frequency.

22. The method of claim 20, wherein said second resonant frequency is approximately half of said first resonant frequency.

23. The method of claim 20, wherein said interrogation signal operates at approximately 13.56 Megahertz.

24. The method of claim 20, wherein said first resonant frequency comprises approximately 13.56 Megahertz, and said second resonant frequency comprises approximately 6.78 Megahertz.

* * * * *